US011802420B2

(12) United States Patent
Rosicki

(10) Patent No.: US 11,802,420 B2
(45) Date of Patent: Oct. 31, 2023

(54) FENCE CONSTRUCTION

(71) Applicant: Thomas Joseph Rosicki, Oakville (CA)

(72) Inventor: Thomas Joseph Rosicki, Oakville (CA)

(73) Assignee: Thomas Joseph Rosicki

( * ) Notice: Subject to any disclaimer, the term of this patent is extended or adjusted under 35 U.S.C. 154(b) by 0 days.

(21) Appl. No.: 17/832,032

(22) Filed: Jun. 3, 2022

(65) Prior Publication Data

US 2023/0058344 A1 Feb. 23, 2023

Related U.S. Application Data

(63) Continuation of application No. 16/849,368, filed on Apr. 15, 2020, now abandoned, which is a continuation of application No. 15/688,428, filed on Aug. 28, 2017, now abandoned, which is a continuation of application No. 13/243,579, filed on Sep. 23, 2011, now abandoned.

(30) Foreign Application Priority Data

Oct. 15, 2010 (CA) ..... CA 2717783

(51) Int. Cl.
*E04H 17/00* (2006.01)
*E04H 17/14* (2006.01)

(52) U.S. Cl.
CPC ..... *E04H 17/1439* (2013.01); *E04H 17/1488* (2021.01)

(58) Field of Classification Search
CPC ..... E04H 17/1443
USPC ..... 256/22, 65.08
See application file for complete search history.

(56) References Cited

U.S. PATENT DOCUMENTS

| | | | |
|---|---|---|---|
| 888,905 | A | 5/1908 | Johnson |
| 2,520,313 | A | 8/1950 | Harris |
| 2,563,530 | A | 8/1951 | Hawkins |

(Continued)

FOREIGN PATENT DOCUMENTS

| | | |
|---|---|---|
| AU | 103292 S | 3/1989 |
| CA | 2142402 | 8/1996 |
| WO | 2009/033092 | 3/2009 |

OTHER PUBLICATIONS

Timber Specialities Co., Board-on-Board Fence, 1 page, Campbelville, Ontario, Canada.

(Continued)

*Primary Examiner* — Victor L Macarthur
(74) *Attorney, Agent, or Firm* — Nixon Peabody LLP

(57) ABSTRACT

A stringer for an off-set board-on-board fence having an inverted U-section elongated body having two mutually opposed sides depending from an intermediate adjoining portion having laterally off-set and longitudinally overlapping first and second sets of spaced board slots extending flush with inside surfaces of the opposed sides for attaching fence boards of predetermined cross-section flush to the inside surfaces of the opposed sides of the stringer. The stringer has board fastening apertures in the opposed sides of the stringer to fasten the fence boards flush with the inside surfaces of the opposed sides. The stringer has a plurality of bracket attachment apertures, preferably square, arranged longitudinally from end to end, between the first and second sets of board slots for attaching post brackets at each end of the stringer. A stringer support of each opposing bracket is within range of one bracket attachment aperture at each end of the stringer.

3 Claims, 9 Drawing Sheets

(56) References Cited

U.S. PATENT DOCUMENTS

| | | | |
|---|---|---|---|
| 3,095,184 | A | 6/1963 | Boxberger |
| 3,136,530 | A | 6/1964 | Case |
| 3,698,692 | A | 10/1972 | Burrows |
| 4,198,034 | A | 4/1980 | Svirklys |
| D257,177 | S | 9/1980 | Demarest |
| 5,100,107 | A | 3/1992 | Latta |
| 5,601,279 | A | 2/1997 | Schwartz |
| D465,286 | S | 11/2002 | Gregori |
| 6,523,807 | B2 | 2/2003 | Calverley |
| 6,557,831 | B2 | 5/2003 | Erwin |
| 6,601,831 | B2 | 8/2003 | Erwin |
| D479,612 | S | 9/2003 | Larsen |
| 6,637,782 | B2 | 10/2003 | Fiebig |
| D548,363 | S | 8/2007 | Hein |
| 7,360,754 | B2 | 4/2008 | Robbins |
| 2007/0221903 | A1 | 9/2007 | Robbins |
| 2008/0157049 | A1 | 7/2008 | Robbins |

OTHER PUBLICATIONS

Timber Specialities Co., Board-on-Board Fence with Lattice Top, 1 page, Campbelville, Ontario, Canada.

Timber Specialities Co., Alternating board on Board Fence, 1 page, Cambellville, Ontario, Canada.

Liniar, Fencing, 1 page, May 2012, United Kingdom.

The Expended Metal Company, Electra Installation Details, Feb. 2002, 4 pages, Hartlepool, England.

USPTO; U.S. Appl. No. 13/243,579; Non Final Office Action dated Sep. 28, 2016.

CIPO; App. No. 2717783; Office Action dated May 29, 2017.

USPTO; U.S. Appl. No. 13/243,579; Final Office Action dated Feb. 27, 2017.

USPTO; U.S. Appl. No. 13/243,579, Final Office Action dated Mar. 21, 2016.

USPTO: U.S. Appl. No. 13/243,579; Final Office Action dated Sep. 4, 2015.

USPTO: U.S. Appl. No. 13/243,579; Non Final Office Action dated Dec. 4, 2014.

FENCE CONSTRUCTION

CROSS REFERENCE TO RELATED APPLICATIONS

This application is a continuation application of U.S. patent application Ser. No. 15/688,428, filed Aug. 28, 2017, which is a continuation of U.S. patent application Ser. No. 13/243,579, filed Sep. 23, 2011, which claims the benefit of the filing date of Canadian Patent Application No. 2717783, filed Oct. 15, 2010, all of which are incorporated herein by reference in their entirety.

FIELD OF THE INVENTION

This invention is directed to a fence construction, and in particular to a fence having horizontal stringers with vertical boards, and in particular a board on board fence, also known as an alternating board on board fence.

BACKGROUND OF THE INVENTION

The board on board fence or alternating board on board fence is a very well known and widely used construction, usually being made entirely of wood, with fence posts set in cement in the ground, with a pair of horizontal wooden stringers nailed to the posts, with fence boards mutually spaced and secured in staggered relation on alternate sides of the stringers by nailing, and located to provide a visual barrier when viewed 'face-on'.

These types of fences are labour intensive, and over time, when servicing is required, such as the replacement of some of the boards, the removal of defective boards can be most difficult. Also, where any hardwood is used, the disassembly of damaged boards can prove exceedingly difficult, time consuming and destructive.

One attempt to overcome these deficiencies in board on board fences can be found in US Pubn. 2007/0221903 (Robbins).

Robbins provides a pair of slotted metal stringers, each of different profile, one of which having a tubular profile and through which notched fence boards are slid, with the board notches then engaging an end of one of the stringer slots in the tubular stringer. A major drawback to this fence is the use of standardized, prefabricated notched boards. In case of damage to the fence in future years, the particular precision-cut notched boards may not be readily available, while the manner of assembly, without the use of positive fasteners may lead to board movement under windy conditions, and the generation of objectionable noise, and general lack of fence strength. Further due to the manner of board attachment, the addition of a new fence board or boards requires the removal of at least one stringer from both its supporting fence posts, to enable the removal of the old board and the insertion of the new board, and the return of the stringer into attached relation with the posts, a most difficult and burdensome task.

BRIEF SUMMARY OF THE INVENTION

The present invention is directed to a board on board fence with two or more fence stringers each having opposed stringer sides depending from an intermediate adjoining portion, the intermediate adjoining portion having a first set of longitudinally spaced board slots extending flush with an inside surface of one of the opposed sides, and a second set of longitudinally spaced board slots extending flush with an inside surface of another of the opposed sides for receiving fence boards in inserted relation through the board slots. The first set of board slots and the second set of board slots are typically mutually spaced with the first set of the board slots and the second set of board slots being longitudinally off-set to form a visual barrier when viewed "face on". The outermost sides of boards inserted through the board slots are secured flush with the inside surface of the respective stringer side.

Board fastening apertures in the stringer sides are positioned adjacent the respective slots to receive board screws, bolts, rivets or other fasteners for insertion into the inserted boards, in securing relation with the boards, to hold the outermost sides of the boards in substantially vertical, flush, supporting, engagement with the inside surfaces of the stringer sides.

The stringers need not be manufactured such that the stringer sides are strictly vertical when the stringers (without inserted fence boards) are attached to their supporting fence posts, provided that stringer sides can be drawn into substantially vertical flush supporting engagement with the inserted fence boards by board screw or other fasteners through the board fastening apertures in the stringer sides. Stringer sides may be angled inwardly or outwardly to the extent that the stringer sides are still capable of being drawn substantially vertical, which is dependent upon the type and thickness of metal used to make the stringer. For example, the stringer sides of an aluminum stringer of a thickness between approximately 0.062" to 0.125" can be angled inwardly or outwardly by 1 from vertical (when installed between fence posts without fence boards inserted therein), that is between 80° to 100° from horizontal (when installed between fence posts without fence boards therein). Those skilled in the art will recognize other metals, metal thicknesses, and stringer side angles which will suffice.

In one aspect stringer sides are angled inwardly, wherein stringer sides hold the fence boards in place for fastening the fence boards to the stringer sides. In this aspect each fence board is firstly inserted through a board slot in an upper stringer and then secondly inserted into a vertically corresponding board slot in a lower stringer, wherein the fence board is then held in place via a friction fit for attaching the fence board to the upper and the lower stringers. Depending upon the pressure exerted on the fence board only one of the two stringer sides adjacent each fence board may need to be so inwardly angled, however if the stringer sides are so angled for all board slots for each fence board the amount of pressure required by each such angled stringer side is minimized thereby reducing the resistance necessary to overcome to draw stringer sides substantially vertical and flush with the inserted fence boards.

Typically fence boards, especially of wood, vary slightly in width and the fence board slots in the stringers will usually be sized to accommodate the fence boards of a highest predetermined thickness. Accordingly, in order to ensure that all predetermined thicknesses of fence boards are held in place for fastening to the stringer sides, a free lower edge of at least one stringer side of each stringer should be bent inwardly from vertical a distance of at least slightly greater than the difference between the width of the board slots and the narrowest predetermined thickness of the fence boards anticipated to be inserted therein.

In use, the ends of the fence stringers are attached to fence posts, preferably aluminum fence posts, set into the ground, preferably in concrete, being secured to the fence posts by way of brackets that attach to the open ends of the fence stringers.

In one aspect the brackets have an enclosure portion to enclose the fence post, and a projecting stringer support for attachment to the intermediate adjoining portion of an end of the fence stringer.

In another aspect the stringer support of the brackets is vertically offset from the bracket enclosure portion by a maximum of one half the height of the enclosure portion of the brackets, whereby in the case of an intermediate fence post two stringers may be attached at the same level, by inverting one bracket in relation to an adjoining bracket, so that the projecting stringer supports are substantially level one with the other resulting in the respective attached stringers being also mutually level. To that end, in one aspect the stringer supports of the brackets are of box section, to provide an upper and a lower attachment surface to which the stringers are attachable.

The intermediate adjoining portion of the stringers has a series of bracket attachment apertures spaced along its length, for attaching the stringer supports to the fence stringer, and enabling stringers being cut to any required length from longer lengths of stringer stock in manufacture or in the field, ensuring that when the brackets are attached to two supporting fence posts that at least one of the bracket attachment apertures at each end of the stringer will always be within range of the stringer aperture in the stringer support of the bracket attached to each end of the stringer. In one aspect the bracket attachment apertures are square, for the insertion and immobilization of carriage bolts. In another aspect the bracket attachment apertures are slotted, in the longitudinal direction, wherein the longitudinal sides of the bracket attachment apertures engage two opposite sides of the square portion of an inserted carriage bolt, to immobilize it rotationally.

Fence boards having a cross-section that fits within the stringer slots are pre-cut to standard lengths and are available at most lumber and building supply stores as 'Fence boards'. The length of such boards are easily shortened in the field as required. (whether wood, composite, or other material).

The upper and lower stringers are aligned so that the board slots of the upper stringer are aligned vertically with the corresponding slots in the lower stringer.

The fence boards are inserted into place, each extending through the vertically aligned slots in the upper and the lower stringers.

Using an endless tensioned band, for example an elastic band or elastic cord, stretched around and joining the two fence posts of a section of fence which is being assembled, the two sides of the band lie adjacent the respective two off-set runs of boards, enabling the positioned band sides each to serve as a datum for a respective run of boards, to which datums the tops of the boards are aligned.

The present invention provides a method of aligning the boards of a fence to form a substantially level run of fence boards, consisting of the steps of attaching an endless band in tensioned relation about a pair of spaced apart fence posts, having two sides of the band extending substantially level and in mutually spaced parallel relation, at a predetermined distance above an uppermost fence stringer secured to the posts and bearing the boards in adjustable, supported relation; elevating one of the boards to position the top of the board in predetermined relation with one side of the band, and securing the positioned board to the stringer; and repeating this procedure for at least one run of fence boards, to form a fence having a substantially level board run.

In the case of the subject board-on-board fence, the other side of the tensioned band lies adjacent the second run of fence boards, and is used as a datum for those boards, in the manner described above.

Single handed use of a screw driver and screw is facilitated using the "Robertson" screw having a tapered square head-recess, which is readily retained in stable mounted relation upon a matched-tapered square section "Robertson" screwdriver bit, for manual or power tool application. However, the use of other screws and other fasteners and attachment tools is contemplated and would be known to those skilled in the art.

The assembly of a fence segment, namely the portion of a fence section excluding the posts, permits single-handed (i.e. one person) installation of both the stringers, the brackets and the fence boards, enabling the erection of a fence segment by a single person.

In the case of the bracket to be attached to each end of the stringer, they may be readily adjustably secured to the two fence posts at their respective desired heights and orientation. The ends of an upper and a lower stringer are then placed over the respective stringer support of each bracket. One end of the stringer is then fastened to the stringer support at that end and then the other end of the stringer is fastened to the stringer support at the other end. The brackets are then vertical raised or lowered on the posts and adjusted for 'level' and tightened, and the stringers are then bolted in place.

Longitudinal registry of the securing carriage bolt is assured by providing an elongated slot in the stringer support of the bracket, through which the carriage bolt is passed. Alternatively, the bracket attachment apertures of the stringer may be in the form of longitudinal slots, where the longitudinal sides of the slots are parallel to secure the square portion of the head of the carriage bolt against rotation (although in this case the stringer aperture need not be a square or slotted). However, fasteners other than carriage bolts are contemplated and would be known to those skilled in the art.

In another aspect both the bracket attachment apertures of the stringer and the stringer aperture of the bracket may comprise slots for a longer range of attachment. This may allow for more than one fastener to be attached for further strength or for greater adjustability. Other methods for the attachment of the stringer to the posts are contemplated.

Other forms of fence brackets include fence brackets having a plurality of coplanar stringer supports extending laterally from an enclosure portion of the bracket. For a fence bracket for a square post the bracket may have one to four coplanar stringer supports, one extending from each side of the enclosure portion of the bracket. Where a fence post serves as a junction for more than two sections of fence the off-set pair of inverted brackets will not suffice and brackets with three, four or more coplaner stringer supports may be required.

This fence construction offers a number of unobvious advantages: the components are all readily manufactured from stock materials, and use stock fasteners; the boards are of natural wood or of recycled plastic of common section, being readily available in pre-cut, measured lengths at most lumber retailers; on-site erection is readily carried out by a single person, with no particular skill requirements once the fence posts are mounted in the ground (usually in concrete); The erected fence is a stiff, strong structure with good resistance to weather attack (e.g. no rusting) of the fastening screws, and with the concealed outer face portions of the fence boards being kept dry within the stringer; and no rotting of aluminum post footings; in case of damage to the fence, individual boards are readily released from their attachment to the stringers, and readily replaced.

Where a tubular fence post is damaged the provision of a tightly fitting sleeve, enables the damaged post to be severed, the tightly fitting sleeve applied to the remaining stub of the original post, and a new fence post mounted to the sleeve. This provision avoids the undue labour of excavating the cement footing, and pouring a new footing. The use of an internal sleeve is preferred, for protective purposes. Post caps to seal off the top ends of the fence posts are preferred, which may be of metal or plastic, and of a variety of styles.

The novel features of the stringers, brackets and fence posts facilitate ready installation of these elements, and the ready installation or replacement of fence boards which suit a 'do-it-yourselfer'.

The invention provides a fence stringer with a U-section elongated body having two mutually opposed sides, each of the opposed sides depending from an intermediate adjoining portion, the intermediate adjoining portion having a first set of mutually spaced board slots extending along an inside surface of one of the opposed sides, and a second set of mutually spaced board slots extending along an inside surface of another of the opposed sides, the first set of board slots and the second set of board slots being of predetermined size for receiving fence boards of predetermined limited cross-section for attaching the fence boards flush to the inside surfaces of the opposed sides of the stringer.

In one aspect the opposed sides of the stringer are substantially perpendicular from a plane connecting an upper end of each stringer side.

In another aspect the stringers are manufactured with at least one of the two stringer sides of a resilient metal bent outwardly with an internal angle of between 90 degrees to 100 degrees from a plane connecting an upper end of each stringer side.

In another aspect the stringers are manufactured with at least one of the two stringer sides of a resilient metal bent inwardly with an internal angle of between 80 degrees to 90 degrees from a plane connecting an upper end of each stringer side.

In another aspect the stringers are manufactured with at least one of the two stringer sides of a resilient metal bent inwardly from perpendicular to a plane connecting an upper end of each stringer side for holding the fence boards in place while attaching the fence boards to the stringers In another aspect a free lower edge of the at least one of the two stringers sides is bent inwardly from perpendicular to a plane connecting an upper end of each stringer side a distance of greater than the difference between the width of the board slots less the narrowest predetermined thickness of the fence boards to be inserted into the board slots sufficient for holding the fence boards in place while attaching the fence boards to the stringers.

In another aspect the free lower edge of the at least one of the two stringer sides is bent inwardly from perpendicular to the intermediate adjoining portion a distance of 1/16 inch greater than the difference between the width of the board slots less the narrowest predetermined thickness of the fence boards to be inserted into the board slots for holding the fence boards in place while attaching the fence boards to the stringers.

In another aspect the stringers are made of aluminum of thickness between 0.062 inch to 0.125 inch.

In one aspect the invention further comprises board fastening apertures in the opposed sides of the stringer, located in predetermined relation with the first set of board slots and the second set of board slots, for inserting fasteners through the board fastening apertures and into the fence boards to secure the fence boards flush with the inside surfaces of the opposed stringer sides.

In one aspect of the invention the intermediate adjoining portion of the elongated body further comprises at least one bracket attachment aperture between the first set of board slots and the second set of board slots at each end of the stringer for attaching each end of the stringer to a bracket to be secured to a fence post.

In another aspect of the invention the intermediate adjoining portion of the elongated body further comprises a plurality of bracket attachment apertures arranged longitudinally between the first set of board slots and the second set of board slots for providing at least one of the plurality of bracket attachment apertures at each end of one or more shorter stringers cut at predetermined lengths from the stringer, for attaching each end of the shorter stringers to a bracket to be secured to a fence post.

In another aspect the intermediate adjoining portion of the elongated body further comprises a plurality of bracket attachment apertures arranged longitudinally between the first set of board slots and the second set of board slots in regular, closely spaced relation, from one end of the stringer to the other end of the stringer, for providing at least one of the plurality of bracket attachment apertures at each end of a shorter stringer cut from the stringer at an arbitrary length, for attaching each end of the shorter stringer to a bracket to be secured to a fence post, the at least one of the plurality of bracket attachment apertures at each end of the shorter stringer being within attachment range of one of the brackets In one aspect the bracket attachment apertures are square for receiving carriage bolts in entrained relation therein.

In another aspect the bracket attachment apertures are longitudinally oriented slots.

In another aspect the longitudinally oriented slots have slot sides longitudinally parallel with each other for receiving a carriage bolt in non-rotatable relation therebetween.

In another aspect the upper surface of the stringer supports of the fence post brackets comprise grip ridges to hold the stringer supports to the stringers even more firmly. However, where the off-set brackets herein are used the lower surface of the box shaped stringer supports also comprise grip ridges for the same purpose when the off-set brackets are used in an inverted position.

The invention also provides a fence stringer assembly comprising the fence stringer and further comprising a pair of the brackets for attaching each end of the stringer to one of the fence posts, the brackets having an enclosure portion of predetermined size to enclose a fence post of predetermined form, a stringer support connected to the enclosure portion for attaching one of the ends of the fence stringer to the stringer support, and means for tightening the enclosure portion around the fence post, the stringer support having a stringer aperture for alignment with the bracket attachment aperture in one of the ends of the fence stringer, and fasteners passing therethrough attaching each of the brackets to the fence stringer.

In one aspect of the fence stringer assembly the stringer aperture in the stringer support comprises a stringer aperture slot in alignment with the one or more bracket attachment apertures in the stringer, whereby the stringer aperture slot in the stringer support of each bracket will always be in alignment with at least one of the bracket attachment apertures at each end of the fence stringer when the enclosure portion of each of the brackets is attached to one of the fence posts.

In one aspect of the fence stringer assembly the bracket enclosure portion of the bracket comprises a neck for tightening the enclosure portion around the fence post, the neck portion connecting the enclosure portion to the stringer support.

In one aspect of the fence stringer assembly the neck comprises neck apertures.

In one aspect of the fence stringer assembly the stringer support of the bracket is off-set from said enclosure portion of the bracket, whereby in use, with the enclosure portion secured to the fence post at a predetermined first elevation, the stringer support will project from the fence post at a different, second elevation, wherein the stringer support off-set is of predetermined value such that a pair of the brackets mounted in mutually adjoining, relatively reversed relation upon a fence post may have the stringer supports projecting from the fence post in mutually laterally aligned relation, to enable opposing fence stringers to be mutually aligned.

The invention also provides a fence section comprising the stringer assembly and comprises the fence posts attached to each end of the fence stringers by the brackets.

In one aspect of the fence section at least one of the fence posts is set in cement in the ground, and has a removable sleeve connecting a lower portion of the post with an upper portion of the post.

In another aspect of the fence section the fence post is tubular and the sleeve is located within the lower portion and the upper portion of the fence post.

The invention also provides a method of repairing a damaged tubular fence post set in cement in the ground, wherein the fence post is damaged at a location above ground, including the steps of severing the fence post at a location below said damage leaving a remainder portion of the post set in the cement; inserting a tube downwardly in close fitting relation within the post remainder portion so as to have a projecting tube portion of said tube projecting above the remainder portion; and applying a further portion of another fence post downwardly over the projecting tube portion, to extend substantially vertically upwardly in supported relation.

The invention also provides a board-on-board fence comprising a pair of horizontally oriented fence stringers in vertically spaced, mutually parallel relation, each fence stringer having an inverted U-section elongated body having two mutually opposed sides, each of the opposed sides depending downwardly from an intermediate adjoining portion, the intermediate adjoining portion having a first set of mutually spaced board slots extending flush with an inside surface of one opposed side of the intermediate adjoining portion and a second set of mutually spaced board slots extending flush with an inside surface of another opposed side of the intermediate adjoining portion, the first set of board slots being in off-set longitudinally overlapping relation to the second set of board slots, the first set of board slots and the second set of board slots being of predetermined size for receiving fence boards of predetermined limited cross-section, the first and second board slots comprising fence boards vertically secured therein, each end of each pair of fence stringers connected to a bracket, each bracket attached to one of two supporting fence posts.

The invention also provides a method of aligning fence boards of a fence to form a substantially level run of fence boards, consisting of the steps of attaching an endless band in tensioned relation about a pair of spaced apart fence posts, having two sides of the band extending substantially level and in mutually spaced parallel relation, at a predetermined distance above a fence stringer secured to the posts and bearing the fence boards in adjustable, supported relation; elevating individual ones of the fence boards so as to position the top of the fence board in predetermined relation with one of the bands, and securing the thus positioned fence board to the fence stringer; and repeating this procedure for at least one run of fence boards, to form a fence having a substantially level board run.

The invention also provides a kit for erecting a portion of a fence between two fence posts mounted in the ground comprising the fence stringer and further comprising a pair of the brackets for attaching each end of the stringer to one of the fence posts, the brackets having an enclosure portion of predetermined size to enclose a fence post of predetermined form, a stringer support connected to the enclosure portion for attaching one of the ends of the fence stringer to the stringer support, and means for tightening the enclosure portion around the fence post, the stringer support having a stringer aperture for alignment with the bracket attachment aperture in one of the ends of the fence stringer, and comprising carriage bolts for attaching each of the brackets to the fence stringer.

In one aspect of the kit the stringer aperture in the stringer support comprises a stringer aperture slot for alignment with the one or more bracket attachment apertures in the stringer, whereby the stringer aperture slot in the stringer support of each bracket will always be in alignment with at least one of the bracket attachment apertures at each end of the fence stringer when the enclosure portion of each of the brackets is attached to one of the fence posts.

In another aspect of the kit the bracket enclosure portion of the bracket comprises a neck for tightening the enclosure portion around the fence post, the neck for connecting the enclosure portion to the stringer support.

In one aspect of the kit the stringer support of the bracket is off-set from said enclosure portion of the bracket, whereby in use, with the enclosure portion secured to the fence post at a predetermined first elevation, the stringer support will project from the fence post at a different, second elevation.

In another aspect of the kit the stringer support off-set is of predetermined value such that a pair of the brackets mounted in mutually adjoining, relatively reversed relation upon a fence post have the stringer supports projecting from the fence post in mutually laterally aligned relation, to enable opposing fence stringers to be mutually aligned.

The invention also provides for a bracket for attaching the fence stringer to a fence post, the bracket comprising an enclosure portion of predetermined size to enclose a fence post of predetermined form, a stringer support connected to the enclosure portion for attaching one of the ends of the fence stringer to the stringer support, and means for tightening the enclosure portion around the fence post, the stringer support having a stringer aperture for alignment with the bracket attachment aperture in one of the ends of the fence stringer for attaching each of the brackets to the fence stringer with bolts.

In one aspect of the bracket the stringer aperture in the stringer support comprises a stringer aperture slot for alignment with the one or more bracket attachment apertures in the stringer, whereby the stringer aperture slot in the stringer support will always be in alignment with at least one of the bracket attachment apertures at either end of the fence stringer when the enclosure portion of the bracket is attached to either of the fence posts.

In one aspect of the bracket the bracket enclosure portion of the bracket comprises a neck for tightening the enclosure portion around the fence post, the neck for connecting the enclosure portion to the stringer support.

In one aspect of the bracket the stringer support of the bracket is off-set from said enclosure portion of the bracket, whereby in use, with the enclosure portion secured to the fence post at a predetermined first elevation, the stringer support will project from the fence post at a different, second elevation.

In another aspect of the bracket the stringer support off-set is of predetermined value such that a pair of the brackets mounted in mutually adjoining, relatively reversed relation upon a fence post have the stringer supports projecting from the fence post in mutually laterally aligned relation, to enable opposing fence stringers to be mutually aligned.

Other aspects of the invention will be understood by those skilled in the art.

BRIEF DESCRIPTION OF THE DRAWINGS

Certain embodiments of the invention are described by way of illustration, without limiting the scope of the invention, reference being made to the accompanying drawings, wherein.

DETAILED DESCRIPTION OF THE PREFERRED EMBODIMENTS

Figure 1:
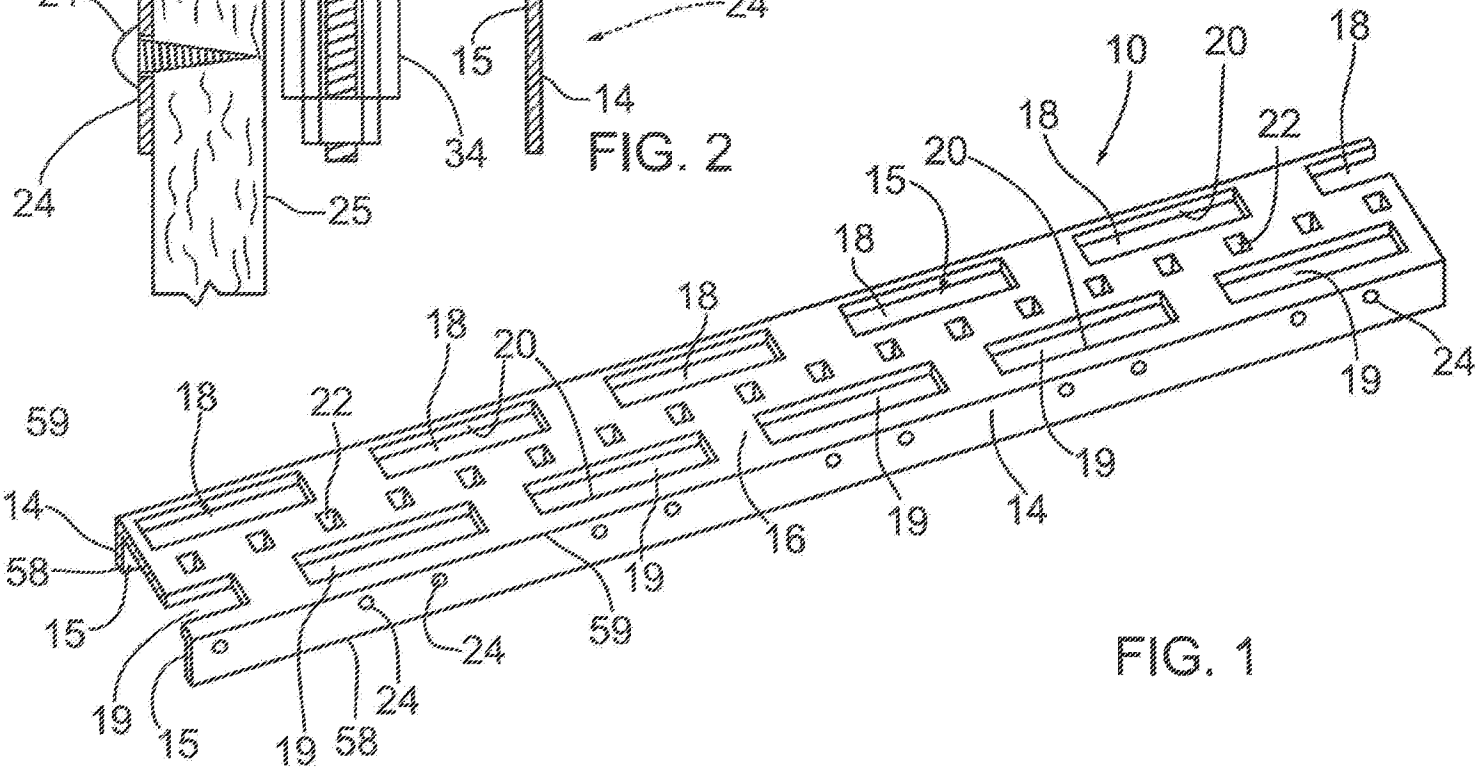
FIG. 1 is a top perspective view of a subject fence stringer in accordance with the present invention.
Figure 2:
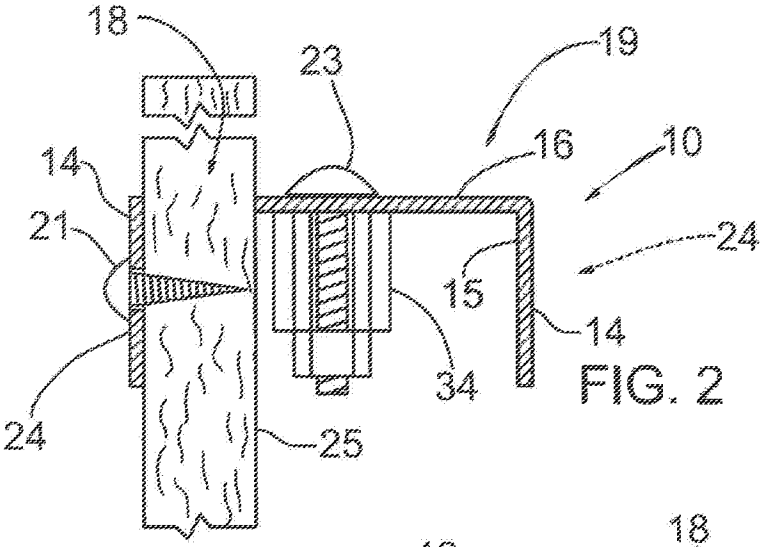
FIG. 2 is a sectional end elevation view of the subject stringer showing a portion of a fence board in secured relation with the stringer.
Figure 11:
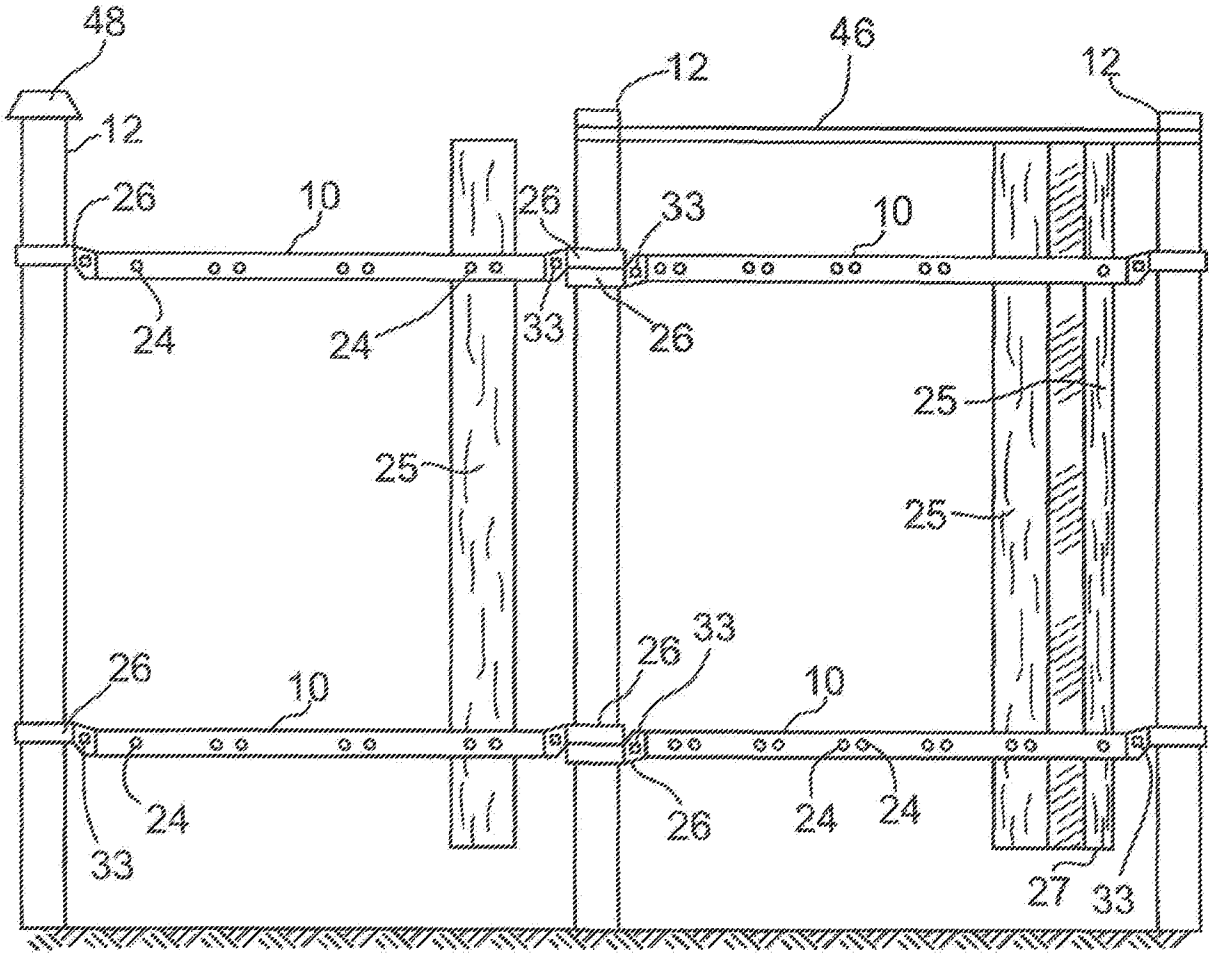
FIG. 11 is a front elevation view of portions of a subject fence under construction.

Referring to FIGS. 1, 2 and 11, a fence stringer 10 is cut to length from stock, to extend between two fence posts 12. The stringer 10 is of inverted U-section, with opposed stringer sides 14 and intermediate adjoining portion 16. The intermediate adjoining portion 16 has two sets of board slots, 18, 19 a first set of board slots 18 and a second set of board slots 19 located flush with inside surfaces 15 of opposed stringer sides 14, such that the outermost sides 20 of the board slots 18, 19 are flush with the inside surfaces 15 of the stringer sides 14. A series of equi-spaced bracket attachment apertures 22 extend longitudinally along the intermediate adjoining portion 16, preferably along the longitudinal centre line of the intermediate adjoining portion, between the first set of board slots 18 and the second set of board slots 19, the bracket attachment apertures 22 being sized to receive a fastener, preferably a carriage bolt 23 (see FIG. 2).

Board screws 21 (FIG. 2) secure the fence boards 25 to the fence stringer 10, securing the fence boards 25 flush against the inside surface 15 of stringer side 14 of the fence stringer 10. FIGS. 1 and 2 show stringer 10 with a planer intermediate adjoining portion 16 and parallel opposing stringer sides 14 perpendicular to the intermediate adjoining portion 16.

Figure 3:
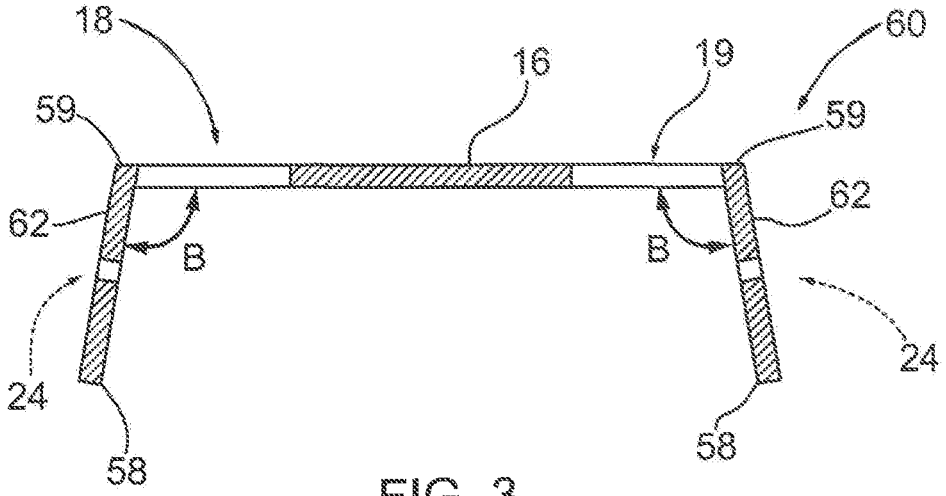
FIG. 3 is a sectional end view of a second embodiment of the stringer.

FIG. 3 shows stringer 60 with intermediate adjoining portion 16 with first and second sets of board slots 18, 19 and depending outwardly bent stringer sides 62. Stringer sides 62 have free lower edges 58 and upper ends 59 and board fastening apertures 24. Stringer sides 62 are bent outwardly at an internal angle of between 90 degrees and 100 degrees from horizontal "B". Stringer sides 62 are drawn substantially vertical when fastened to fence boards 25 by board screws 21 or other fasteners such as bolts. Metal stringer sides 62 must be resilient enough to be drawn substantially vertical when fastened to fence boards 25, for example, stringers made of aluminum of thickness between 0.062 inch to 0.125 inch.

Figure 4:
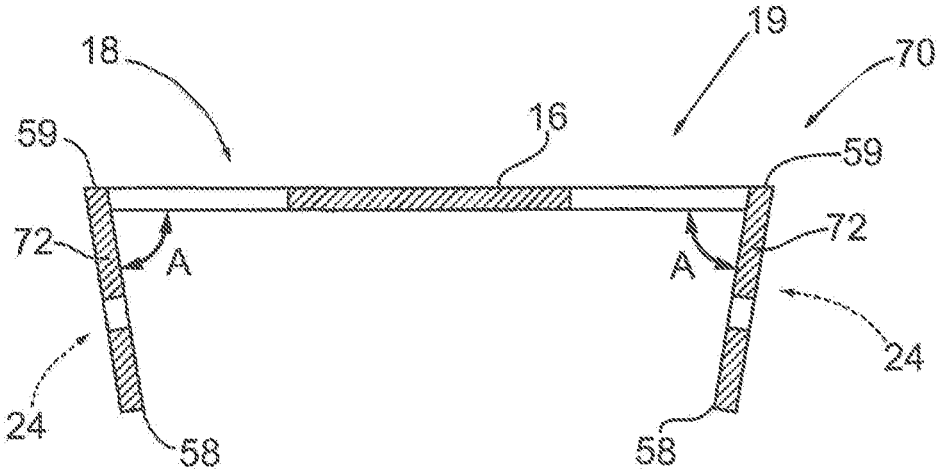
FIG. 4 is a sectional end view of a third embodiment of the stringer.

FIG. 4 shows stringer 70 with intermediate adjoining portion 16 with first and second sets of board slots 18, 19 and depending inwardly bent stringer sides 72. Stringer sides 72 have free lower edges 58 and upper ends 59 and board fastening apertures 24. Stringer sides 72 are bent inwardly at an internal angle of between 80 degrees and 90 degrees from horizontal "A". Stringer sides 72 are drawn substantially vertical when fastened to fence boards 25 by board screws 21 or other fasteners such as bolts. Metal stringer sides 72 must be resilient enough to be drawn substantially vertical when fastened to fence boards 25, for example, stringers made of aluminum of thickness between 0.062 inch to 0.125 inch.

Figure 5:
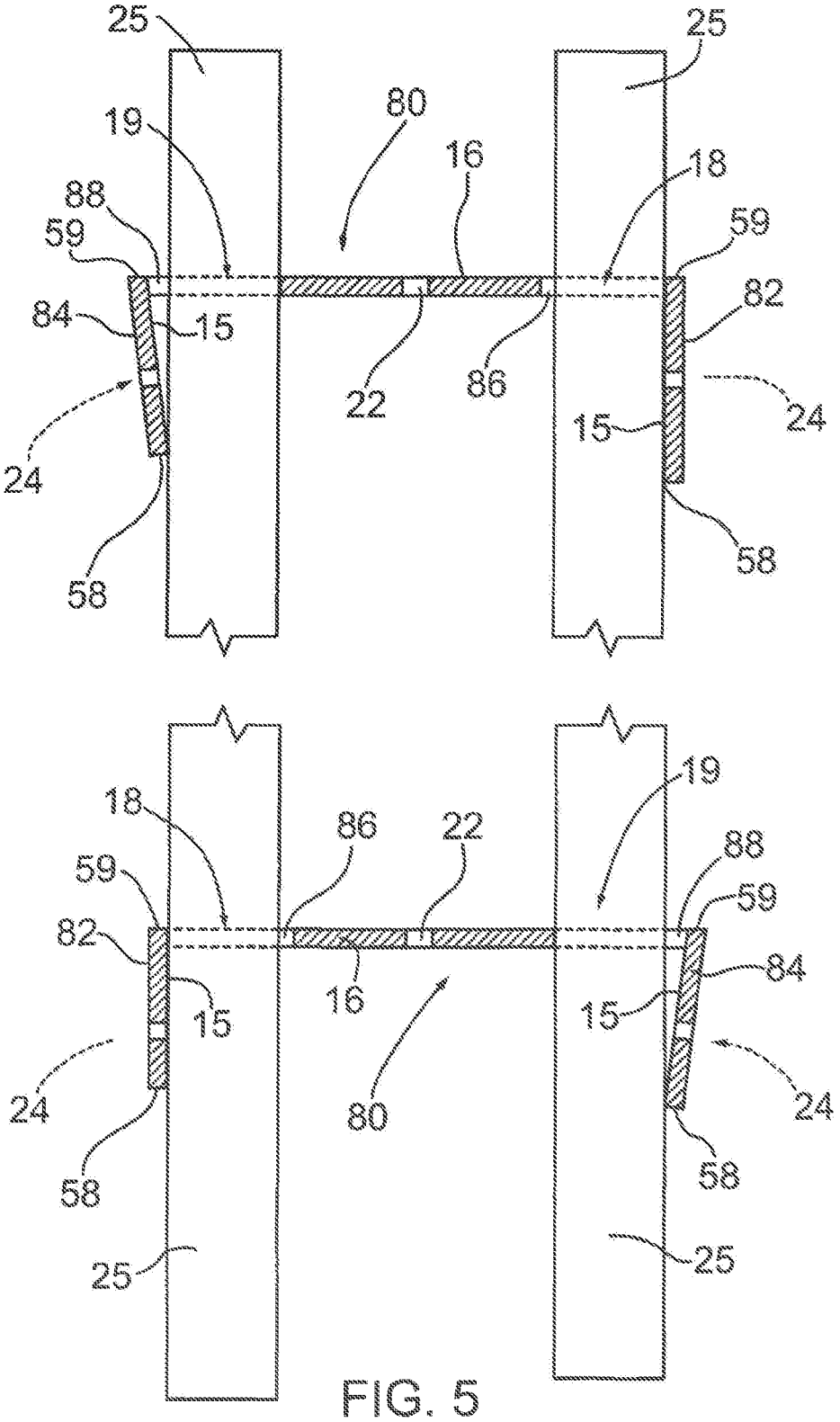
FIG. 5 is a fragmented sectional end view of a pair of stringers of a fourth embodiment with fence boards inserted into the board slots awaiting fastening to the stringers.

FIG. 5 shows stringers 80 each having a horizontal intermediate adjoining portion 16 with central bracket attachment apertures 22 and first and second sets of board slots 18, 19, and one depending vertical stringer side 82 and one inwardly angled stringer side 84 for holding fence boards 25 in place while stringer sides 84 are fastened to fence boards 25. Both stringer sides 82, 84 have free lower edges 58 and upper ends 59 and board fastening apertures 24. Typically fence boards, especially of wood, vary slightly in width and the width of fence board slots 18, 19 are sized for the largest predetermined width of standard fence boards 25. FIG. 5 shows the location of gaps 88 between the width of board slots 19 and the minimum predetermined thickness of standard fence boards before inwardly bent stringer sides 84 are fastened to the fence boards 25.

Accordingly, in order to ensure that all predetermined thicknesses of fence boards 25 are held in place for fastening to the stringer sides 84, a free lower edge 58 of at least one stringer side 84 of at least one stringer 80 should be bent (biased) inwardly from vertical a distance of greater than the difference between the width of the board slots 19 less the narrowest predetermined thickness of the fence boards 25 to be inserted into the board slots 19 sufficient for holding the fence boards 25 in place while attaching the fence boards 25 to the stringers 80. Although FIG. 5 shows only one profile of stringer 80 wherein upper and lower stringers 80, 80 are reversed such that each fence board 25 is held in place for fastening by only one inwardly angled stringer side 84, both opposing stringer sides of both stringers are preferably inwardly angled to increase the holding power of the free lower edges 58 and reduce the pressure required by each stringer side 84 to hold the fence board 25 in place for fastening. In this embodiment metal stringer sides 84 need to be rigid enough to hold fence boards 25 for fastening and resilient enough to be able to be drawn substantially vertically and flush when fastened to fence boards 25 to provide structural rigidity to the fence section. For example, stringers made of aluminum of thickness between 0.062 inches to 0.125 inches where the free lower edges 58 of both opposing stringer sides 84 of both the upper and the lower stringers are bent inwardly a distance of 1/16 inch greater than the difference between the width of the board slots 19 less the narrowest predetermined thickness of the fence boards 25 to be inserted into the board slots 19 are believed to be sufficient for holding the fence boards 25 in place while attaching the fence boards 25 to the stringers.

Figure 6:
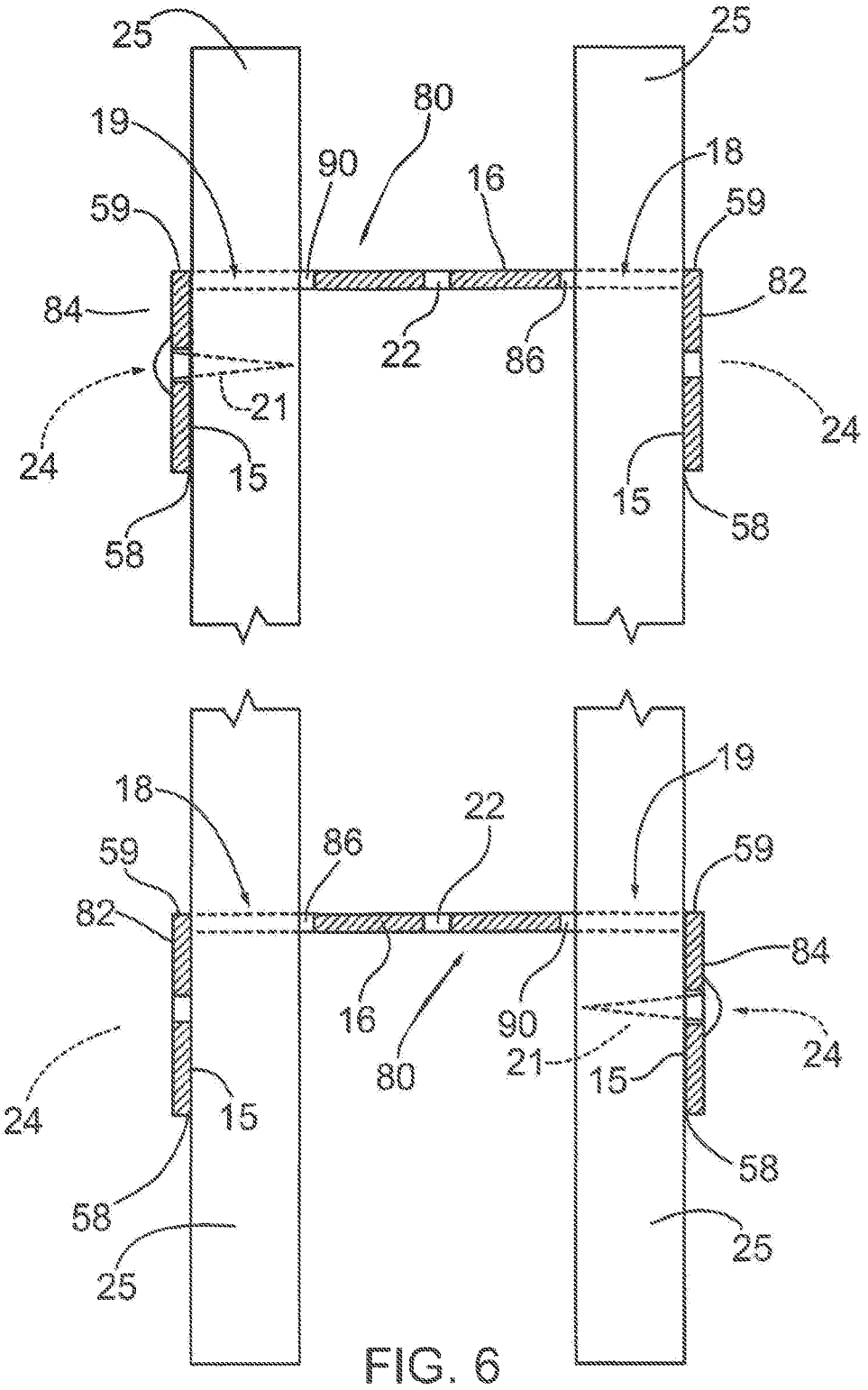
FIG. 6 is a fragmented sectional end view of the pair of stringers of the fourth embodiment with fence boards inserted into the board slots wherein initially inwardly angled stringer sides have been substantially vertically fastened to the adjacent fence boards.
Figure 9:
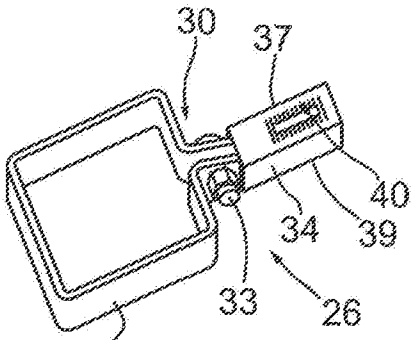
FIG. 9 is a perspective view of the fence post bracket of FIG. 7.
Figure 10:
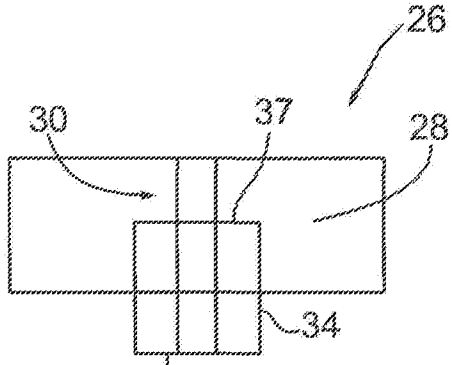
FIG. 10 is an end view of the fence post bracket of FIG. 7 showing the one offset stringer support.
Figure 7:
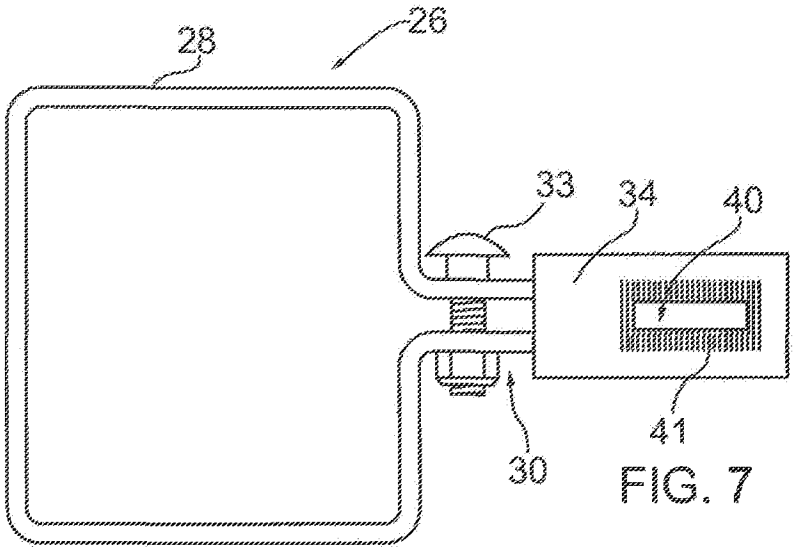
FIG. 7 is a top plan view of an off-set fence post bracket with one stringer support.

FIG. 6 also shows stringers 80 each with intermediate adjoining portion 16 and is identical to FIG. 5 except that inwardly bent stringer sides 84 have been attached to fence boards 25 by board screws 21 through board fastening apertures 24 to draw stringer sides 84 into substantially vertical flush supporting frictional engagement with fence boards 25 which eliminates gap 88 between the outside surface of fence boards 25 in board slots 19 and the inside surface 15 of stringer sides 84, which gap is shifted to gap 90 between the inside surfaces of fence boards 25 in board slots 19 and the innermost sides 35 of board slots 19, and which gap 90 is then substantially the same as gap 86 with respect to fence boards 25 in board slots 18 adjacent vertical stringer sides 82.

Turning to FIGS. 7, 8, 9, and 10 post brackets 26 are illustrated as having an enclosure portion 28, for a square fence post, preferably a 3"×3" hollow aluminum fence post, although other sectional shapes, and other dimensions and materials for fence posts are contemplated. Fence posts may be hollow, such as in the case of metal fence posts or solid in the case of wood or composite fence posts. However it will be understood that the enclosure portion 28 of brackets 26 may also conform to other shapes, including circular form, sized to fit standard sized circular-section steel fence posts.

The enclosure portion 28 has an off-set neck portion 30 with opposed neck apertures 32, at least one of which is preferably square for receiving a carriage bolt 33, to tighten and secure the enclosure portion 28 firmly to a fence post 12. A stringer support 34 of rectangular tube form extends from the neck portion 30, the stringer support having an upper surface 37 and lower surface 39, each of which having a corresponding stringer aperture 40, to receive a carriage bolt 23.

The upper and lower surfaces 37, 39 of the stringer support 34 are illustrated as preferably having a series of grip ridges 41, to better secure stringer support 34 to stringer 10.

Figure 8:
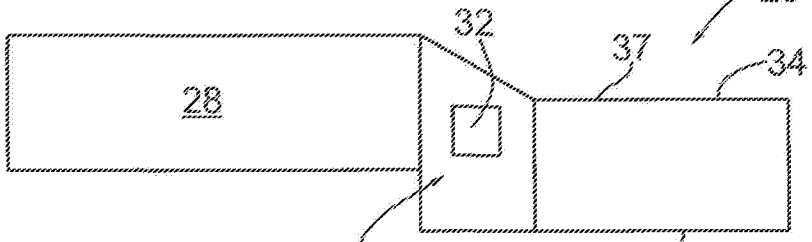
FIG. 8 is a side elevation view of the bracket of FIG. 7, in an unbolted condition.

The off-setting of the stringer support 34, best seen in FIG. 8, enables the post brackets 26 to be inverted, so that a pair of the brackets 26 can be mounted together in mutually adjoining relatively reversed relation upon a fence post 12, to extend each of two stringer supports 34 in mutually horizontal aligned relation with the associated stringers 10 also being in mutually horizontal aligned relation, due to the inversion of one of the brackets 26 (see FIG. 11). A pair of brackets 26, with off-set stringer supports 34, when in inverted relation can extend two stringer supports for a fence post 12 of square section, either at 90 degrees (not shown) or 180 degrees (shown in FIG. 11).

The bracket attachment apertures 22 of fence stringers 10 and stringer apertures 40 of stringer supports 34 of bracket 26 are preferably attached with carriage bolts 23. Alternatively, other types of bolts may be used.

In use, the stringers 10 are cut to length for the desired fence, and may initially be used as 'meter rods' for locating the post holes, and setting the fence posts 12 in place in the ground. With the posts 12 securely embedded in the ground, usually in concrete, the post brackets 26 are oriented to a desired configuration, such as 180 degrees as shown in FIG. 11, and readily slid down and tightened in gripping relation to the two end fence posts 12 at the respective desired stringer heights and bracket orientation to ensure the respective stringers 10 being mutually level.

A first lower bracket 26 for a first post 12 is secured at a predetermined distance, such as 6 to 8 inches above grade, and a second lower bracket 26 for a second post is then initially loosely installed at the predetermined distance, to permit ready adjustment when subsequently leveling the associated stringer.

A first end of a lower stringer is then mounted and loosely secured to the first lower bracket of the first post.

A second end of the lower stringer is then mounted to the second lower bracket of the second post, and the second lower bracket is adjusted along the second fence post to level the stringer, and the second lower bracket is then tightened in place around the second post.

The first end of the lower stringer is then tightened to the first lower bracket which is in turn tightened around the first post and the stringer re-checked for levelness.

The upper brackets are usually positioned such that the upper projecting portion of the fence boards will be the same length as the portion of the fence boards extending below the lower stringer, i.e. some six to eight inches.

The foregoing procedure can be accomplished by an individual working singlehandedly. FIG. 11 also shows cap 48 to divert water.

Installation and attachment of the fence boards can then proceed, as described above.

It will be evident that installers working in pairs can proceed much more rapidly.

Figure 12:
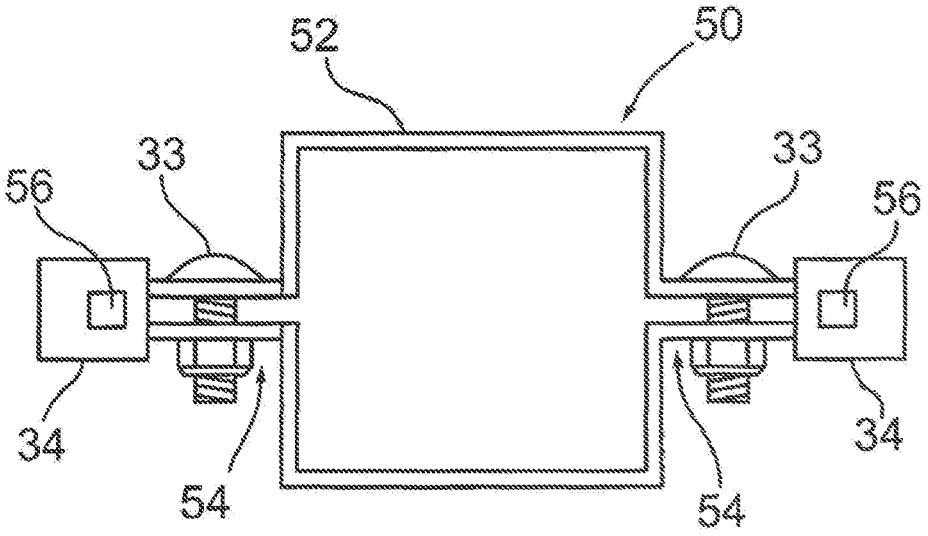
FIG. 12 is a top plan view of an alternate fence post bracket with two stringer supports at 0 and 180 degrees.
Figure 13:
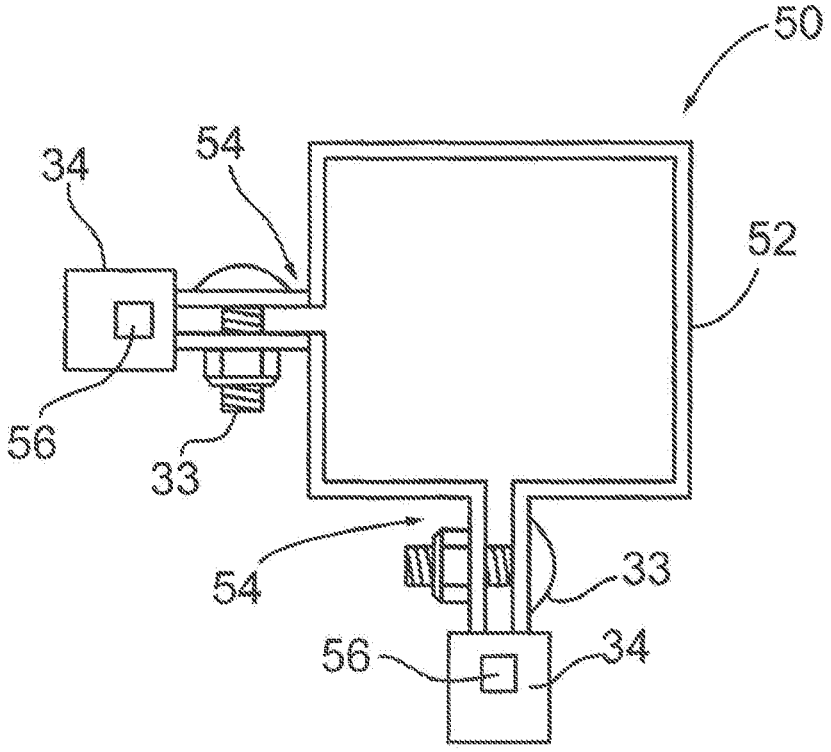
FIG. 13 is a top plan view of an alternate fence post bracket with two stringer supports at 0 and 90 degrees.
Figure 14:
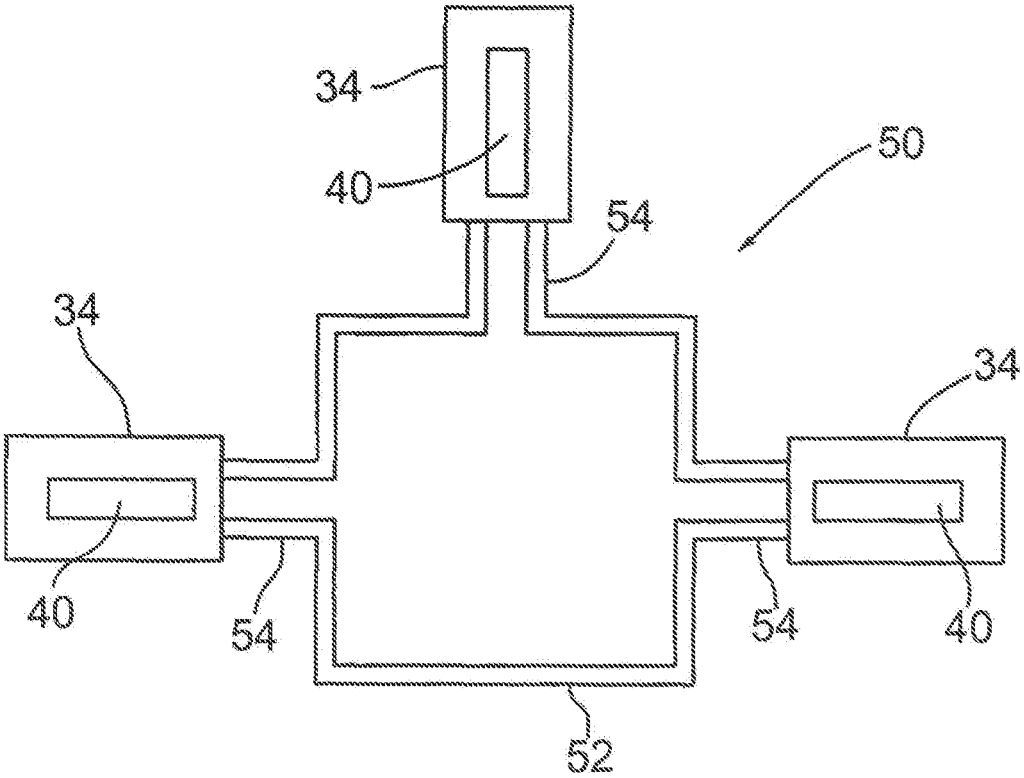
FIG. 14 is a top plan view of an alternate fence post bracket with three stringer supports at 0, 90, and 180 degrees, with neck aperture bolts removed.
Figure 15:
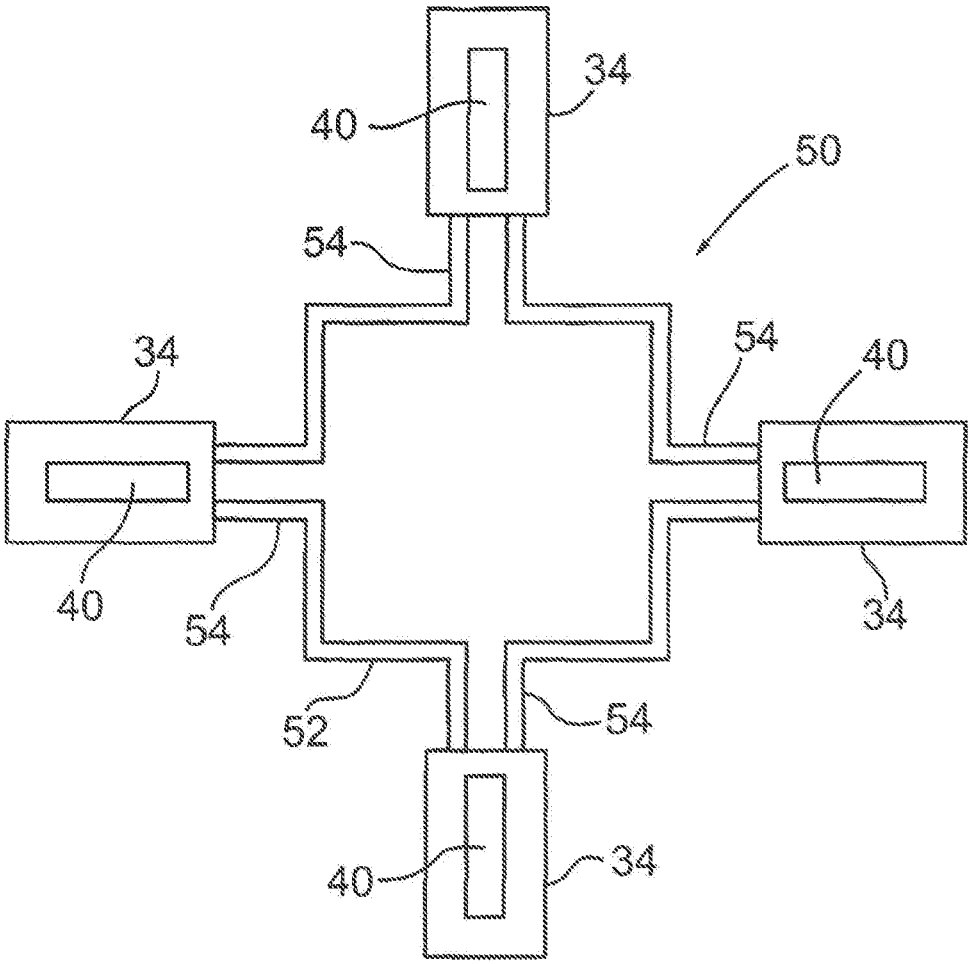
FIG. 15 is a top plan view of an alternate fence post bracket with four stringer supports at 0, 90, 180 and 270 degrees, with neck aperture bolts removed.

Alternatively, with respect to FIGS. 12, 13, 14, and 15, non-offset brackets 50 with enclosure portions 52 may be used wherein the stringer supports 34 are not off-set. Stringer supports 34 are connected to enclosure portions 52 by neck 54 which is tightened to fence posts (not shown) by carriage bolts 34. FIGS. 12 and 13 show (square) non-slotted stringer apertures for use with slotted bracket attachment apertures (not shown) in stringers 10. FIGS. 14 and 15 show stringer supports 34 with slotted stringer apertures 40. In this case different brackets with different numbers of stringer supports are required. Bracket 50 may be configured with one stringer support (not shown), for the end of a run of fence. FIG. 12 shows bracket 50 with two stringer supports 34 at 180 degrees for an intermediate post in a run of fence. FIG. 13 shows bracket 50 with two stringer supports 34 at 90 degrees for a corner fence post. FIG. 14 shows bracket 50 with three stringer supports 34 for a fence post supporting three runs of fence. FIG. 15 shows bracket 50 with four stringer supports 34 for a fence post supporting four runs of fence. Accordingly, for a four sided fence post a different bracket is required for each of one, two, three, and four stringer supports, usually at 90, 180, 270 and 360 degrees. Further such non-set-off brackets are required for applications requiring three or four stringer supports as the off-set reversed brackets 26 only provide level stringer supports where two stringer supports are required.

The subject fence is readily maintained, with broken or damaged boards readily removed and replaced. Damaged stringers can also be readily replaced. In the case of damage or fracture of a fence post, an intermediate sleeve enables a replacement post to be connected to the remainder of the original post footing. Usually the sleeve will be internal to the damaged original fence post in the ground and the new post placed thereover, however the sleeve can be external if enough of an undamaged stub projects from the ground, in which case the new post is inserted into the sleeve (although the external sleeve is typically less visually pleasing, It shall be understood by those skilled in the art that the above embodiments are only examples of the invention and other embodiments of the subject invention which fall within the scope of the invention and the appended claims will be apparent to those skilled in the art.

PARTS LIST

10. Fence stringer
12. Fence posts
14. (opposed) Stringer sides
15. Inside surfaces (of stringer sides)
16. Intermediate adjoining portion (of stringers)
18. First set of board slots
19. Second set of board slots
20. outermost sides (of board slots)
21. Board screws
22. Bracket attachment apertures
23. Carriage bolt (for connecting stringers to bracket)
24. Board fastening apertures
25. Fence Boards
26. Post brackets
27. Partial fence board (for partial slot)
28. Enclosure portion (of post brackets)
30. Offset neck portion (of bracket)
32. Neck apertures
33. Carriage bolt (for tightening enclosure portion about fence post)
34. Stringer Support
35. Innermost sides (of board slots)
37. Upper surface (of stringer support)
39. Lower surface (of stringer support)
40. Stringer aperture
41. Grip ridges
46. Endless tensioned band
48. Fence post cap
50. Non off-set bracket
52. Enclosure portion (of non off-set bracket)
54. Neck (of non off-set bracket)
56. Non-slotted stringer aperture
58. Free lower edge (of stringer sides)
59. Upper end (of stringer sides)
60. Stringer with outwardly bent stringer sides
62. Outwardly bent stringer sides
70. Stringer with inwardly bent stringer sides
72. Inwardly bent stringer sides
80. Stringer with one vertical stringer side and one inwardly bent stringer side
82. Vertical stringer side
84. Inwardly bent stringer side
86. Gap between width of board slot and width of smallest fence board
88. Location of gap between width of board slot and fence board adjacent inwardly angled stringer side before fence board is fastened vertically to stringer side
90. Location of gap between width of board slot and fence board adjacent inwardly angled stringer side after fence board is fastened vertically to stringer side
A. Internal angle of inwardly bent stringer sides from horizontal
B. Internal angle of outwardly bent stringer sides from horizontal

I claim:

1. A fence comprising:

a fence stringer comprising:

an intermediate adjoining portion having a first end and a second end, wherein the intermediate adjoining portion includes (i) a plurality of boards slots configured to receive fence boards and (ii) a plurality of bracket apertures positioned about a length of the intermediate adjoining portion;

two mutually opposed stringer sides, wherein each of the opposed stringer sides extends from the intermediate adjoining portion, wherein an inside surface of each of the board slots in combination with one of the two mutually opposed stringer sides forms a planar surface;

two fence posts, wherein a first of the two fence posts is located proximal to the first end and a second of the two fence posts is located proximal to the second end; and a first bracket including (i) a first enclosure portion, (ii) a first neck portion, and (iii) a first stringer support, wherein the first neck portion is located between the first enclosure portion and the first stringer support, wherein an upper surface of the first enclosure portion extends above an upper surface of the first stringer support, and wherein the first bracket is secured to the fence stringer via one of the plurality of bracket apertures proximal to the first end; and a second bracket including (i) a second enclosure portion, (ii) a second neck portion, and (iii) a second stringer support, wherein the second neck portion is located between the second enclosure portion and the second stringer support, wherein a lower surface of the second enclosure portion extends below a lower surface of the second stringer support, and wherein the second bracket is secured to the fence stringer via one of the plurality of bracket apertures proximal to the second end.

2. The fence of claim 1, wherein the opposed stringer sides include a plurality of board fastening apertures, and wherein each board slot of the plurality of board slots has at least two board fastening apertures aligned therewith.

3. The fence stringer of claim 1, wherein the plurality of board slots includes a first set of board slots and a second set of board slots, and wherein the first set of board slots are located in offset arrangement to the second set of board slots.

* * * * *